US007071430B2

(12) United States Patent
Farano et al.

(10) Patent No.: US 7,071,430 B2
(45) Date of Patent: Jul. 4, 2006

(54) ADJUSTABLE PRESSURE ELEMENT, PARTICULARLY FOR ELECTRIC HOUSEHOLD APPLIANCES

(75) Inventors: Michele Farano, Turin (IT); Angelo Muneretto, Rivoli (IT)

(73) Assignee: ELBI International S.p.A., Turin (IT)

( * ) Notice: Subject to any disclaimer, the term of this patent is extended or adjusted under 35 U.S.C. 154(b) by 177 days.

(21) Appl. No.: 10/898,980

(22) Filed: Jul. 27, 2004

(65) Prior Publication Data

US 2005/0051045 A1 Mar. 10, 2005

(30) Foreign Application Priority Data

Jul. 28, 2003 (IT) ..... TO20030122 U

(51) Int. Cl.
*H01H 35/36* (2006.01)

(52) U.S. Cl. ..... 200/81.4; 200/83 P

(58) Field of Classification Search ..... 200/81.4, 200/83 R, 83 P, 83 S, 83 SA, 83 B
See application file for complete search history.

(56) References Cited

U.S. PATENT DOCUMENTS

| | | | | |
|---|---|---|---|---|
| 4,254,313 A | | 3/1981 | Baader | |
| 4,278,856 A | * | 7/1981 | Owens | 200/82 R |
| 4,593,166 A | * | 6/1986 | Hirota et al. | 200/83 J |
| 5,189,269 A | * | 2/1993 | Stahly | 200/83 P |
| 5,432,310 A | * | 7/1995 | Stoeger | 200/82 R |
| 5,932,857 A | * | 8/1999 | Stander et al. | 200/83 B |
| 6,040,536 A | * | 3/2000 | Miller et al. | 200/83 N |
| 6,472,624 B1 | * | 10/2002 | Harris et al. | 200/81.9 R |
| 6,495,777 B1 | * | 12/2002 | Chou | 200/83 R |

FOREIGN PATENT DOCUMENTS

GB 2 219 950 A 12/1989

* cited by examiner

*Primary Examiner*—Richard K. Lee
(74) *Attorney, Agent, or Firm*—Sughrue Mion, PLLC

(57) ABSTRACT

The sensor comprises a body in which a diaphragm is mounted so as to define a variable-volume chamber to which a fluid pressure is supplied in use, and a plurality of electrical switches connected to the diaphragm so that the diaphragm can bring about switching of the switches when the pressure in the chamber exceeds corresponding different threshold values which are predetermined by associated calibration means including, for each switch, a respective spring the compression of which can be varied by means of a corresponding reaction member the position of which relative to the body is adjustable.

The reaction members are connected rigidly to the ends of an interconnection structure translatable in a guide structure. This guide structure comprises a plurality of laterally-slotted, tubular guide projections, each for guiding a corresponding reaction member, and an intermediate guide projection for guiding the sliding of a central portion of the interconnection structure with which are associated a resilient member tending to bring about a relative movement between the interconnection structure and the body and a snap locating device for restraining the interconnection structure selectively, against the action of the resilient means in one of a plurality of positions relative to the body, in each of which respective different pressure threshold values are associated with the electrical switches.

2 Claims, 4 Drawing Sheets

ADJUSTABLE PRESSURE ELEMENT, PARTICULARLY FOR ELECTRIC HOUSEHOLD APPLIANCES

FIELD OF THE INVENTION

The present invention relates to a pressure sensor, particularly for electric household appliances.

More specifically, the subject of the invention is a pressure sensor of the type comprising:

a support body in which a diaphragm is mounted so as to define a variable-volume chamber to which a fluid pressure is supplied in use, and a plurality of electrical switches mounted in the body and connected to the diaphragm so that the diaphragm can bring about switching of the switches when the pressure in the chamber exceeds corresponding different threshold values which are predetermined by associated calibration means including, for each switch, a respective spring the compression of which can be varied by means of a corresponding reaction member the position of which relative to the body is adjustable.

BRIEF SUMMARY OF THE INVENTION

The object of the present invention is to provide a pressure sensor of the type defined above which allows the pressure threshold values operatively associated with the electrical switches to be changed quickly and easily.

This and other objects are achieved according to the invention by a pressure sensor of the type specified above, characterized in that:

the reaction members are connected rigidly to the ends of corresponding flanges of an interconnection structure, and are preferably integral therewith, the interconnection structure being translatable relative to the body in a guide structure which comprises a plurality of laterally-slotted, tubular guide projections each for guiding a corresponding reaction member, and an intermediate guide projection for guiding the sliding of a central portion of the interconnection structure, there being associated with the central portion of the interconnection structure:

resilient thrust means tending to urge the interconnection structure away from the body, and snap locating means for restraining the interconnection structure selectively, against the action of the resilient means, in one of a plurality of positions relative to the body in each of which respective different pressure threshold values are associated with the electrical switches.

BRIEF DESCRIPTION OF THE DRAWINGS

Further characteristics and advantages of the invention will become clear from the following detailed description which is given purely by way of non-limiting example with reference to the appended drawings, in which.

DETAILED DESCRIPTION OF THE INVENTION

Figure 2:
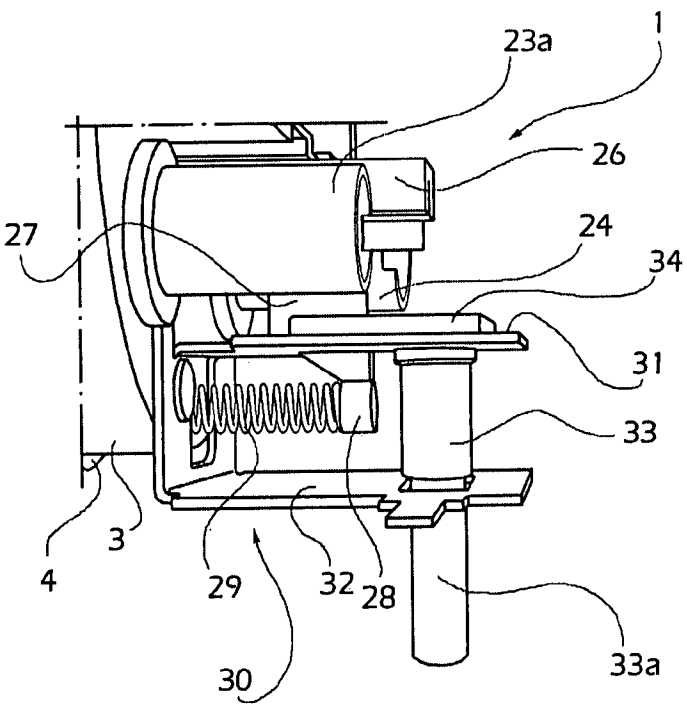
FIG. 2 is a partial perspective view which shows a detail of the device of FIG. 1, indicated by the arrow II in that drawing.
Figure 1:
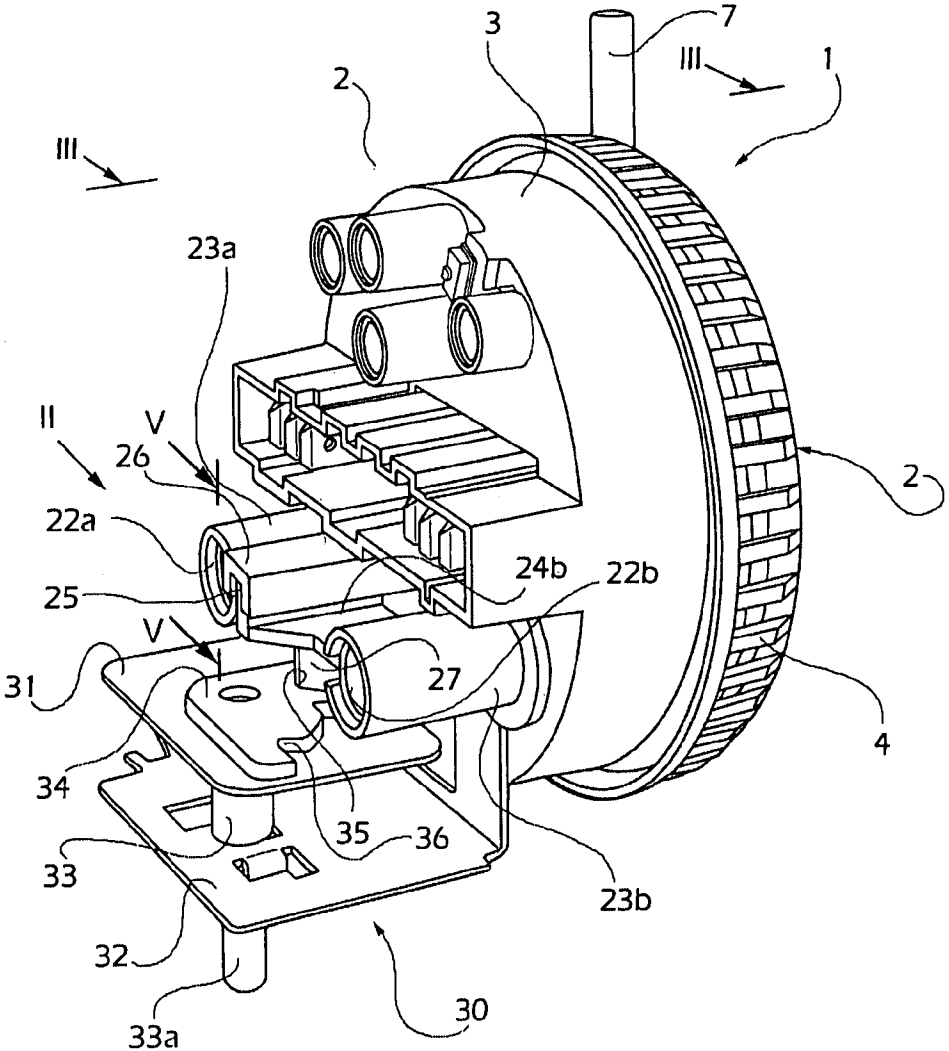
FIG. 1 is a perspective view of a pressure sensor according to the invention.
Figure 3:
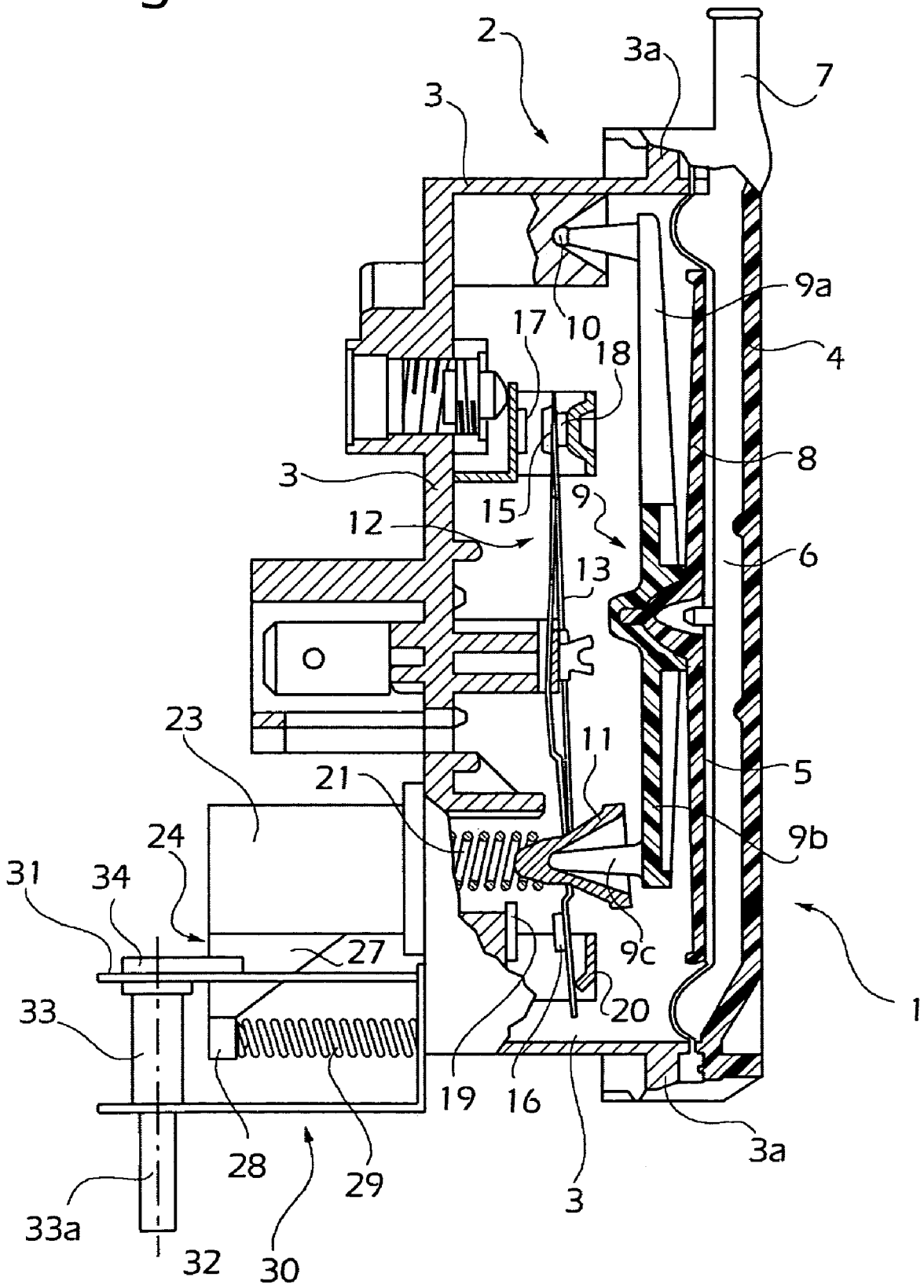
FIG. 3 is a section taken on the line III—III of FIG. 1.

A pressure sensor according to the invention is generally indicated 1 in FIGS. 1 to 3.

The device 1 comprises a support body or casing 2 which, in the embodiment shown, is formed by a substantially cup-shaped half-shell 3 and by an associated cover 4.

The cover 4 is snap-coupled with a rim 3*a* surrounding the mouth or opening of the half-shell 3 and the periphery of a resilient diaphragm 5, for example, made of elastomeric material, is gripped between them (FIG. 3).

The diaphragm 5 defines, together with the cover 4, a variable-volume chamber 6 to which a fluid pressure is supplied in use through an inlet connector 7. In the embodiment shown by way of example, the connector 7 extends radially from the cover 4.

In known manner and as shown in FIG. 3, the diaphragm 5 bears on a substantially flat, rigid element 8, for example, made of plastics material. This element is coupled, by means of rod-like portions, with a plurality of transmission members only one of which is visible in FIG. 3, where it is generally indicated 9.

In the embodiment illustrated by way of non-limiting example, the pressure sensor 1 is of the so-called two-level type, that is, it can operatively supply signals when the pressure in the chamber 6 exceeds a first predetermined threshold value and a second predetermined threshold value, respectively. Accordingly, two intermediate transmission members 9 of the type indicated above and described further below are provided in the body 2 of the device 1.

Each intermediate transmission member 9 has an arm 9*a* which is mounted for pivoting at 10 in the half shell 3 at the side of the diaphragm 5 remote from the cover 4, and at least one further arm 9*b* which is arranged opposite the previous arm and has a rod 9*c* engaged in a substantially conical cap 11.

Electrical switches (two), each generally indicated 12, are mounted in the half-shell 3 at the side of the transmission members 9 remote from the cover 4 (only one switch is visible in FIG. 3).

Each switch 12 comprises, in known manner, a blade 13, preferably made of metal, in particular of the type described, for example, in U.S. Pat. No. 4,254,313, or of the type according to UK patent application No. 2 219 950, to which reference should be made for further details.

The blade 13 of each switch has an elongate shape and its ends carry movable contact members, indicated 15 and 16, which can cooperate with respective pairs of fixed contacts 17, 18 and 19, 20, which are fixed to the half-shell 3.

The transmission members 9 associated with each switch 12, with the respective rod-like portion 9*c* and the associated conical element 11, can act on the blade 13 of the corresponding switch as the pressure of the fluid in the variable-volume chamber 6 varies.

When the pressure in the chamber exceeds a predetermined threshold value, the diaphragm can bring about snap-switching of the blade 13 of a switch 12 by means of an intermediate transmission member 9, and this occurs, in particular, when the pressure exerted by the associated rod 9*c* on the blade 13 exceeds the resilient reaction of a calibration spring 21.

Figure 5:
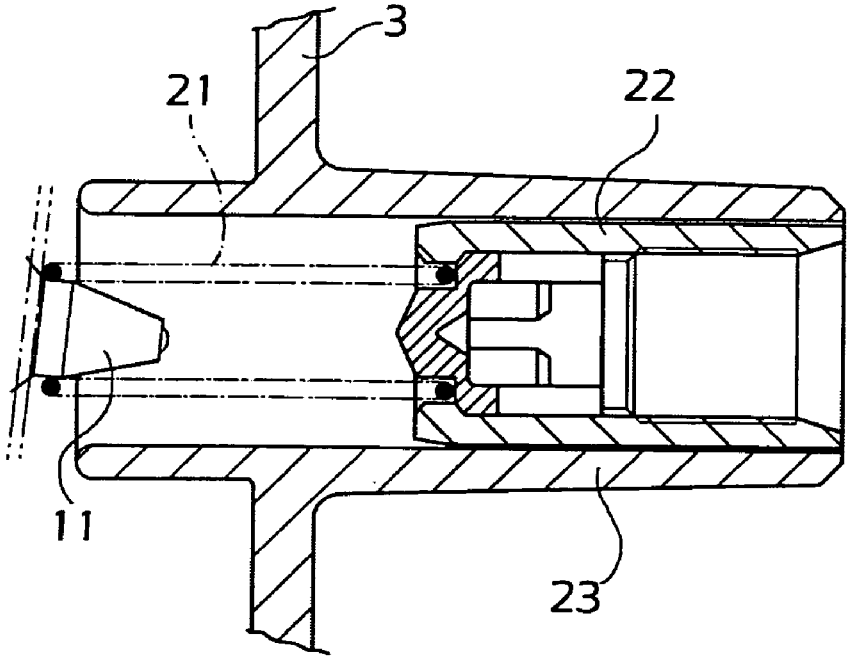
FIG. 5 is a section taken on the line V—V of FIG. 1.
Figure 6:
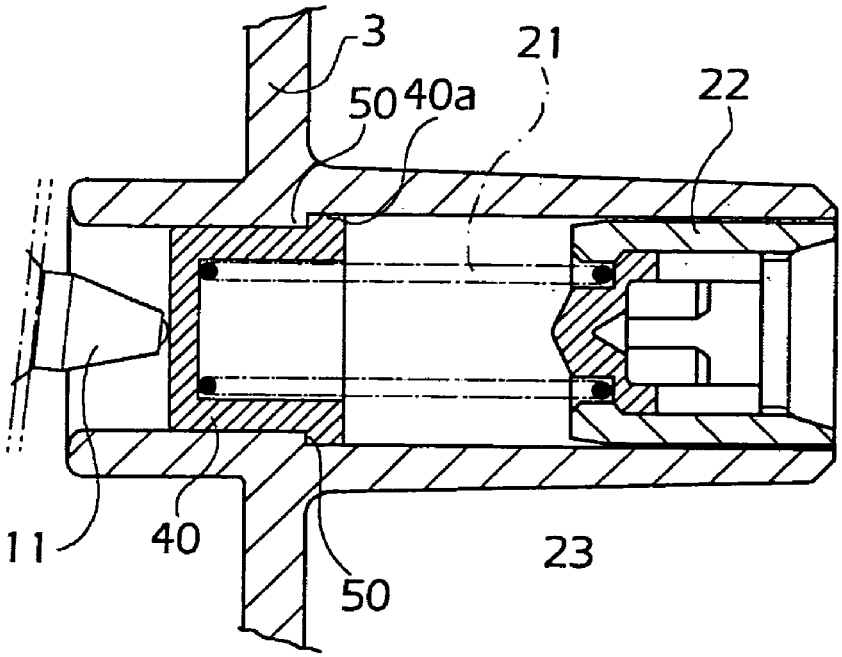
FIG. 6 is a sectioned view similar to that of FIG. 5 and shows a variant.

As can be seen, for example, in FIG. 5 or FIG. 6, the compression of each spring 21, can be varied by means of an associated reaction member 22 which is mounted so as to be translatable in a tubular projection 23 which extends outwardly from the base wall of the half-shell 3 of the device.

In the embodiment shown by way of example, as already mentioned above, the pressure sensor is of the two-level type and accordingly comprises two electrical switches 12 with associated transmission members 9 which connect them mechanically to the diaphragm 5. The snap blades 13 of the switches 12 are associated with respective variable-compression springs 21 and corresponding respective reaction members 22 which are translatable relative to the body 3 and the positions of which relative to that body are adjustable in the manner which will be described below.

Figure 4:
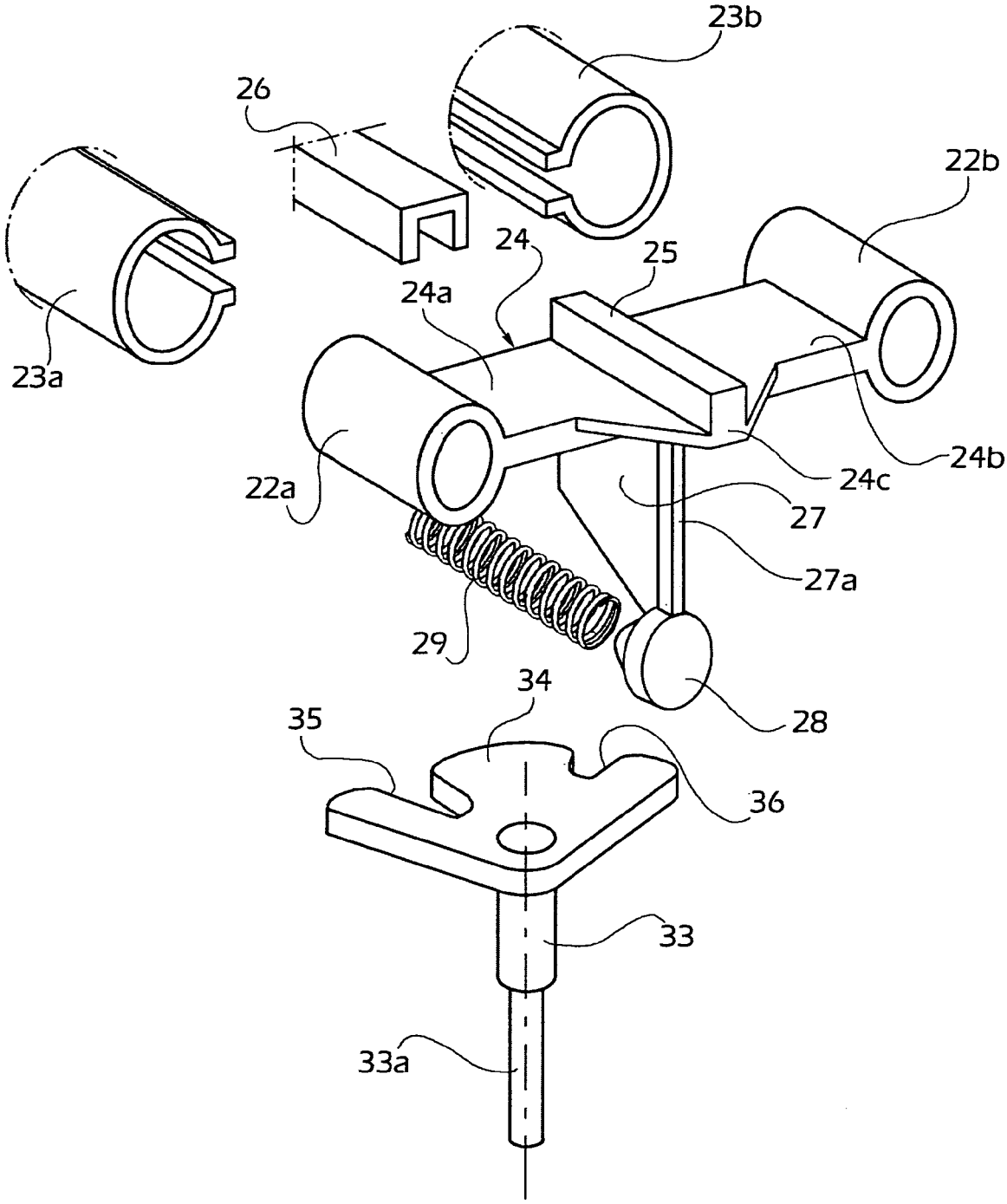
FIG. 4 is a partial, exploded, perspective view which shows some parts of the device of the previous drawings.

The reaction members of the springs 21 associated with the two electrical switches are indicated 22*a* and 22*b*, respectively, and the corresponding tubular guide projections of the body 3 are indicated 23*a* and 23*b* in FIGS. 1, 2 and 4.

As can be seen in particular in FIG. 4, the reaction members 22*a* and 22*b* associated with the springs for the calibration of the thresholds of the two electrical switches are connected rigidly to the ends of corresponding flanges 24*a* and 24*b* of an interconnection structure, generally indicated 24. The structure 24 is preferably formed integrally with the reaction members 22*a* and 22*b* as a single piece and, in the version illustrated, has a substantially T-shaped general configuration.

The tubular guide projections 23*a* and 23*b* of the body 3 have respective lateral slots, through which the flanges 24*a* and 24*b* of the interconnection structure 24 extend slidably.

The interconnection structure 24 advantageously has, on its top, in its intermediate portion 24*c*, a rectilinear, raised portion 25 which engages in a guided manner in a corresponding guide projection 26 which is firmly fixed to the half-shell 3 of the body of the sensor and has an inverted channel-like shape.

The sliding coupling between the raised portion 25 of the interconnection structure 24 and the corresponding guide 26 reliably and safely prevents the structure 24 being subjected to transverse oscillations in operation.

With reference to FIG. 4, the interconnection structure 24 has, centrally, an arm or lower extension 27 which extends substantially in a plane perpendicular to the common plane of the flanges 24*a* and 24*b*.

At its lower end, the arm 27 carries a reaction element 28 which engages an end of a helical spring 29 the other end of which reacts against the sensor body (FIGS. 2 and 3).

The helical spring 29 tends to urge the interconnection structure 24 away from the half-shell 3 of the sensor body 2.

As can best be seen in FIGS. 1 to 3, a support structure, generally indicated 30 and having a substantially U-shaped cross-section with two superimposed and facing plate-shaped portions 31 and 32, is connected to the outer face of the end wall of the half-shell 3. This structure extends beneath the tubular guide projections 23*a*, 23*b* and, in the upper plate-shaped portion 31, has a slot through which the arm 27 of the above-described interconnection structure 24 can slide.

A shaft 33 is mounted rotatably between the plate-shaped portions 31 and 32 of the support structure 30. A cam member 34 is connected to the upper end of this shaft which projects above the plate-shaped portion 31; the cam member 34 is rotatable about an axis which is substantially vertical as viewed in the drawings.

On the side facing the interconnection structure 24, the cam member 34 has a plurality of notches or slots, indicated 35 and 36 in FIGS. 1 and 4. These notches are arranged substantially radially relative to the axis of rotation of the shaft 33 of the cam member 34 and have respective different lengths.

With reference to FIG. 4, in the embodiment illustrated, the notch or slot 35 has a more pronounced radial extent than the notch or slot 36.

The cam member 34 cooperates operatively with the interconnection structure 24 and, in particular, with the outer edge 27*a* of its arm 27 (FIG. 4). In particular, when the arm 27 is engaged in the notch 35 of the cam member 34 (FIG. 1), the interconnection structure 24 and the associated reaction members 22*a* and 22*b* are arranged, under the action of the reaction spring 29, in a first operative position, in which the members 22*a* and 22*b* cooperate with the corresponding springs 21 inside the device, associating with the corresponding electrical switches 12 respective first threshold values of the pressure in the chamber 6, at which threshold values the switches switch.

By rotation of the shaft 33, the cam member 34 can be snapped into a second operative position, not shown in the drawings, in which the arm 27 of the interconnection structure 24 engages in the notch 36. In this position, since the notch 36 is radially shorter and its base is farther from the axis of the shaft 33, the structure 24 and the associated reaction members 22*a* and 22*b* adopt, under the action of the spring 29, a second operative position to which a state of greater compression of the springs 21 associated with the electrical switches 12 corresponds. Different threshold values of the pressure in the chamber 6 are correspondingly associated with the switches which switch at those different threshold values in operation.

Naturally, the cam member 34 may be provided with three or more different notches which have different radial extents corresponding to correspondingly different calibrations of the threshold pressure at which the switching of the switches 12 of the pressure sensor takes place.

The free end portion 33*a* of the shaft 33 may advantageously be connected to a manually operable member such as a knob which is accessible from outside the electric household appliance to enable the user to set the desired pressure thresholds to be associated with the switches of the device, for example, according to the expected washing load for a washing machine.

FIGS. 5 and 6 show two different methods of connection between a generic reaction member 22 and the cap 11 of the corresponding intermediate transmission member 9 by means of the spring 21 interposed between them.

In FIG. 5, the spring 21 acts directly on the corresponding conical cap 11 whereas, in the variant of FIG. 6, the spring 21 acts on the cap 11 indirectly, that is, by means of a substantially cup-shaped intermediate member 40; the intermediate member 40 is preferably provided with an external collar 40*a* for cooperating with an annular shoulder 50 of the half-shell 3 to limit the maximum movement to which the cap 11 and the associated intermediate transmission member 9 can be subjected.

Naturally, the principle of the invention remaining the same, the forms of embodiment and details of construction may be varied widely with respect to those described and illustrated purely by way of non-limiting example, the invention extending to all embodiments which achieve equal utility by virtue of the same innovative concepts.

What is claimed is:

1. An adjustable pressure sensor particularly for electric household appliances, comprising:

a support body in which a diaphragm is mounted so as to define a variable-volume chamber to which a fluid pressure is supplied in use, and a plurality of electrical switches mounted in the body and connected to the diaphragm so that the diaphragm is capable of bringing about switching of the switches when the pressure in the chamber exceeds corresponding different threshold values which are predetermined by associated calibration means including, for each switch, a respective spring the compression of which can be varied by means of a corresponding reaction member the position of which relative to the body is adjustable, the reaction members being connected rigidly to the ends of corresponding flanges of an interconnection structure and being preferably integral therewith, the interconnection structure being translatable relative to the body in a guide structure which comprises a plurality of laterally-slotted, tubular guide projections, each for guiding a corresponding reaction member, and an intermediate guide projection for guiding the sliding of a central portion of the interconnection structure, there being associated with the central portion of the interconnection structure;

resilient means being provided, which tend to bring about a relative movement between the interconnection structure and the body, and snap locating means being also provided, for restraining the interconnection structure selectively, against the action of the resilient means, in one of a plurality of positions relative to the body in each of which respective different pressure threshold values are associated with the electrical switches.

2. A pressure sensor according to claim 1, in which the interconnection structure is generally T-shaped with a central arm operatively cooperating with a cam member fixed firmly to a rotatable shaft, the cam member having a plurality of seats which are spaced apart angularly about the axis of the shaft and have different radial extents so that, when the central arm of the interconnection structure engages in one of the seats, the interconnection structure is arranged, under the action of the resilient means, in a different operative position relative to the body of the sensor.

* * * * *